US005159947A

United States Patent [19]

Chuang et al.

[11] Patent Number: 5,159,947

[45] Date of Patent: Nov. 3, 1992

[54] COLLAPSIBLE TENT FRAME

[76] Inventors: Ching-Pao Chuang, No. 128-18, Yu Che, Yu Che Li, Ma Tou Chen; Jung-Tai Lin, No. 135, Po Ai Street, Chia Li Chen, both of Tainan Hsien, Taiwan

[21] Appl. No.: 835,843

[22] Filed: Feb. 18, 1992

[51] Int. Cl.[5] ..... E04H 15/36

[52] U.S. Cl. ..... 135/102; 135/109; 403/91; 403/101

[58] Field of Search ..... 135/102, 103, 109; 403/91, 101, 102, 157; 52/66

[56] References Cited

U.S. PATENT DOCUMENTS

| | | | |
|---|---|---|---|
| 2,991,103 | 7/1961 | Vanwersch et al. | 403/91 |
| 3,848,615 | 11/1974 | Warner et al. | 135/102 |
| 3,906,968 | 9/1975 | Black | 135/102 |
| 4,098,281 | 7/1978 | Bonfilio | 135/102 |
| 4,227,542 | 10/1980 | Bonfilio | 135/102 |
| 4,402,544 | 9/1983 | Arfim et al. | 135/102 X |
| 4,425,929 | 1/1984 | Von Mosshaim | 135/102 |
| 4,766,980 | 8/1988 | Engle | 403/157 X |
| 4,806,042 | 2/1989 | Swank et al. | 403/101 X |
| 4,905,946 | 3/1990 | Wang | 403/92 X |
| 4,929,113 | 5/1990 | Shen | 403/91 X |

FOREIGN PATENT DOCUMENTS

| | | | |
|---|---|---|---|
| 574681 | 4/1959 | Canada | 135/102 |
| 0624440 | 7/1927 | France | 135/102 |
| 1371680 | 7/1964 | France | 135/102 |
| 0626187 | 10/1961 | Italy | 135/102 |
| 0888846 | 2/1962 | United Kingdom | 135/102 |

*Primary Examiner*—David A. Scherbel
*Assistant Examiner*—Lan Mai
*Attorney, Agent, or Firm*—Morton J. Rosenberg; David I. Klein

[57] ABSTRACT

A collapsible tent frame has two pole position bases and a plurality of reverse U-shaped frame units to combine with the pole position bases to support a tent roof cloth. Each frame unit consists of two main frame poles having their lower ends screwed with the position bases to stand in radiant direction, and a vertical extension pole connected with a main frame pole at one end and with a horizontal extension pole at the other end with a collapsible hinge to form a reverse U-shaped frame unit. After all frame units are assembled with the position bases, two position ropes can be inserted through each frame unit firmly to keep all the frame units spaced apart from each other at a proper distance. Two sustaining bases are provided to sustain the outer-most frame unit pulled upward to form an entrance for this tent.

2 Claims, 5 Drawing Sheets

COLLAPSIBLE TENT FRAME

BACKGROUND OF THE INVENTION

There are many kinds of collapsible tents in use and on market nowadays, but they are generally a little complicated so that person unexperienced in setting up a tent may not be able to magnage to set it up so smoothly.

SUMMARY OF THE INVENTION

The collapsible tent frame devised in the present invention has been planned to have a simple structure to enable an unexperienced person to assemble easily.

The collapsible tent frame in the present invention comprises two pole position bases and a plurality of reverse U-shaped frame units assembled together.

Each pole position base has two parallel semi-circular arms, a semi-circular slot under each semi-circular arm and a semi-circular groove between two walls under the semi-circular slots.

Each reverse U-shaped frame unit respectively consists of two main frame poles, two vertical extension poles connected with the main frame poles a horizontal frame tube, and two horizontal extension poles connected with both sides of the horizontal frame tube. One main frame pole and one vertical extension pole form one of the parallel vertical portions of each reverse U-shaped frame unit, and a horizontal frame tube and two horizontal extension poles form the horizontal portion of each frame unit.

In assembling, the main frame poles are adapted to have their lower ends standing on the semi-circular groove in the pole position base in radiant direction and respectively screwed tightly between the two semi-circular arms by means of a bolt and a wing nut. The bolt is inserted through the two semi-circular slots in the pole position base and also through a sidewise through hole bored in the lower end portion of each main frame pole.

A collapsible hinge is provided to join a vertical extension pole in each parallel portion of the reverse U-shaped frame unit with a horizontal extension pole in each horizontal portion of the frame unit in nearly a right angle.

Two position ropes are used to keep all reverse U-shaped frame units spaced apart from one another, after all frame units are assembled with the two pole position bases, by inserted through a sidewise hole provided in the joined end of each vertical and each horizontal extension pole and kept therein firmly by a central projection in the end of each vertical extension pole in the parallel portion of the frame unit.

A pole sustaining base is additionally provided to sustain the two parallel portions in the outer-most frame unit from falling down, when the outer-most frame unit with a few neighboring frame units are pulled to swing upward towards the middle of the tent so as to form an entrance.

DETAILED DESCRIPTION OF THE INVENTION

Figure 1:
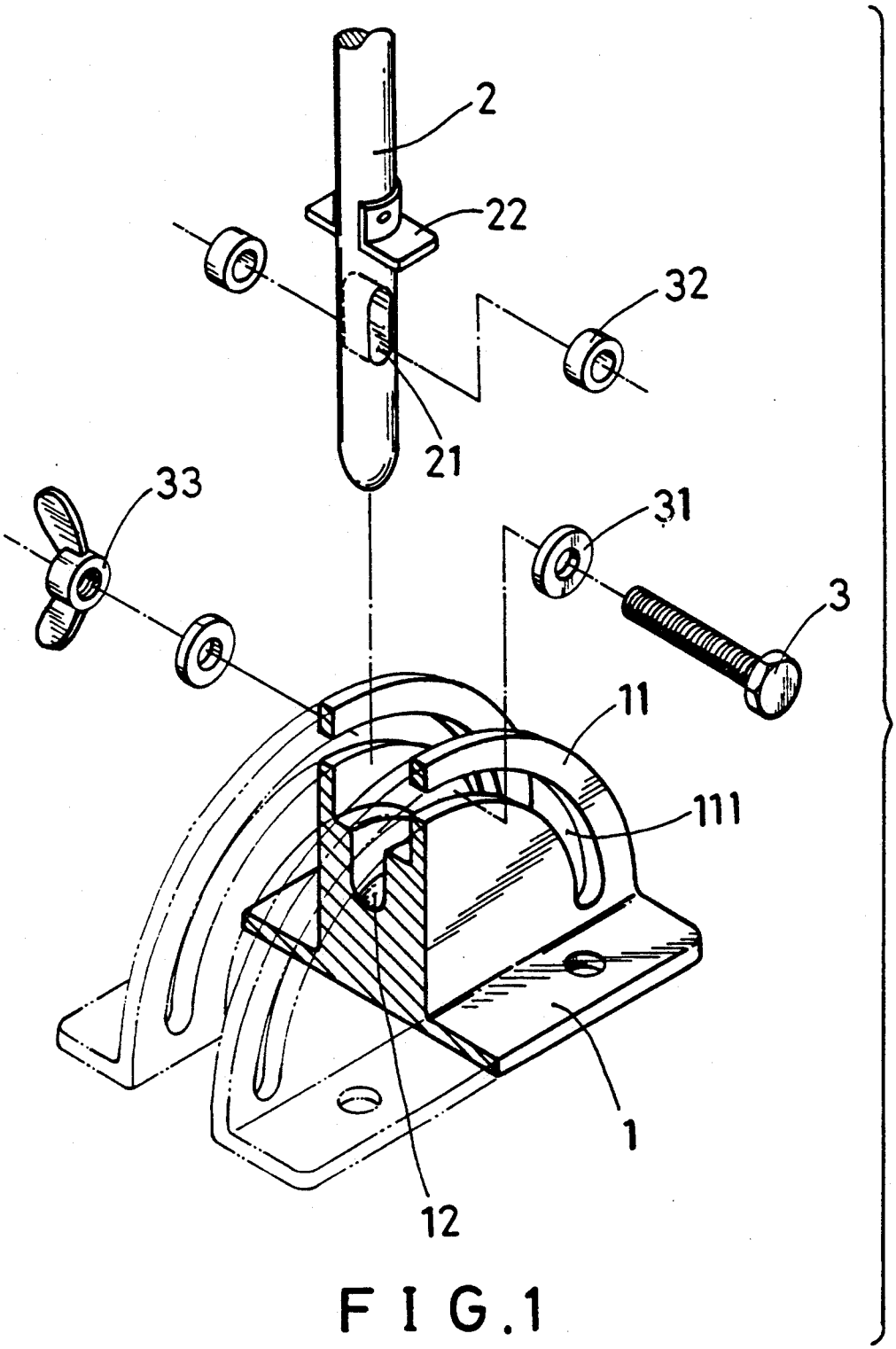
FIG. 1 is an exploded perspective view of the pole position base and the main frame pole in the collapsible tent frame in the present invention.

The collapsible tent frame in the present invention comprises two pole position bases 1 and a plurality of reverse U-shaped frame units as its main components, as shown in FIG. 1.

The pole position base 1 is nearly reversely T-shaped, having two semi-circular parallel arms 11 extending from one side to the opposite side, a semi-circular slot 111 under each arm 11, and a semi-circular groove 12 between the two walls under the slots 111.

Each reverse U-shaped frame unit consists of two main frame poles 2, two vertical extension poles 201, one frame tube 4 and two horizontal extension poles 401 combined together. Each main frame pole 2 has a through sidewise hole 21 in the lower end portion for a bolt 3 passing through the semi-circular slots 111 in the pole position base 1 to pass through to screw with a wing nut 33, and two washers 31 and two rings 33 are additionally pinched by the bolt 3 and the wing nut 33 to keep the main frame pole tightly with the pole position base 1.

Figure 3:
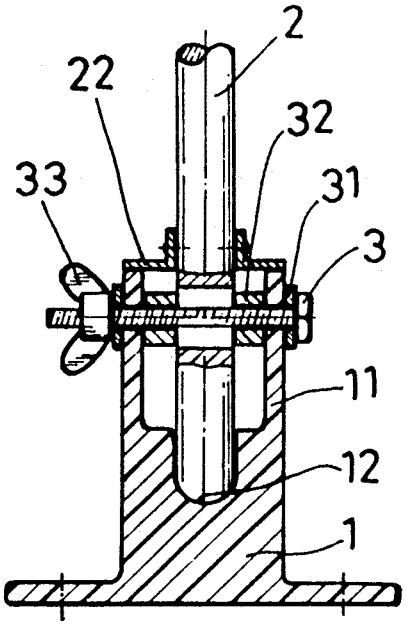
FIG. 3 is a side view of the pole position base combined with the main frame poles in the collapsible tent frame in the present invention.
Figure 2:
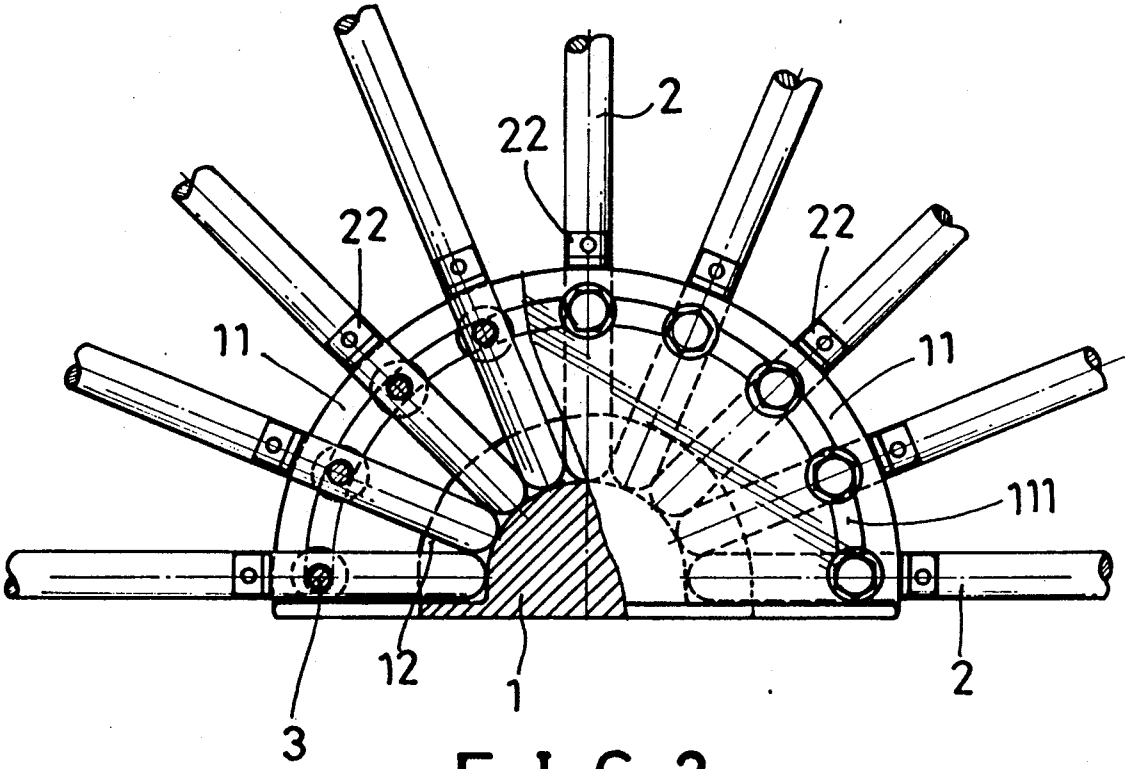
FIG. 2 is a front view of the pole position base combined with the main frame poles in the collapsible tent frame in the present invention.

In assembling the main frame pole 2 with the pole position base 1, as shown in FIGS. 2 and 3, at first a proper number of main frame poles 2 are made to have their lower ends stand in the groove 12 in the pole position base 1, and then the bolt 3 is inserted first through one of the slot 111, then the sidewise hole 21 and then the other slot 111 and lastly screws with the wing nut 33 to pinch the frame pole 2 tightly with help of the washers 31 and the rings 32. The main frame pole 2 is connected with one end of a vertical extension pole 201, which is then connected with an horizontal extension pole 401 at its other end in nearly a right angle, and the horizontal extension poles 401 is also connected with one end of a horizontal frame tube 4, and a guide rope 5 is bound orderly with several extension poles 401 and connected on a sheave 41 fixed on the extension pole of a middle frame unit. Two position ropes 6 are also provided to position the frame units equally spaced apart from one another.

The above mentioned structure of the pole position base 1 and the main frame poles in the collapsible tent frame are not what this invention intends to improve. The improvements in the present invention are a position member 22 and a collapsible hinge 23.

The position member 22 is provided around the outer surface of the main frame pole 2 a little up the rectangular hole 21, having two side pieces projecting to two opposite sides to contact on the upper surface of both the semi-circular arms 11 to hold the main frame pole 2 stabilized in its position after the main frame pole 2 has been assembled with the pole position base 1.

Figure 6:
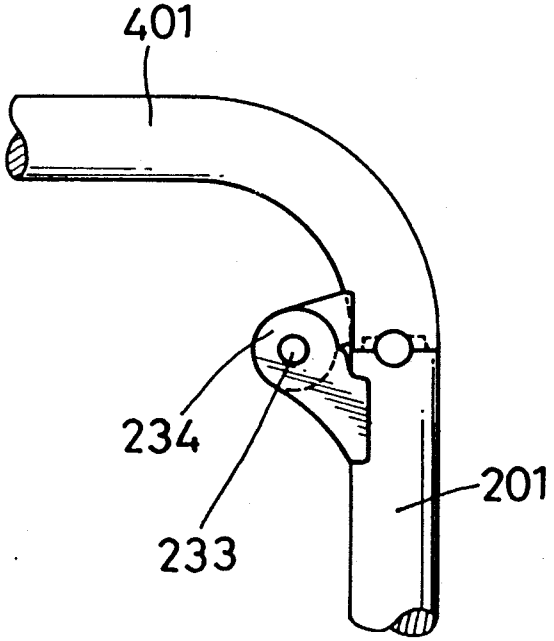
FIG. 6 is a side view of the two extension poles connected with the collapsible hinge in the collapsible tent frame in the present invention.
Figure 5:
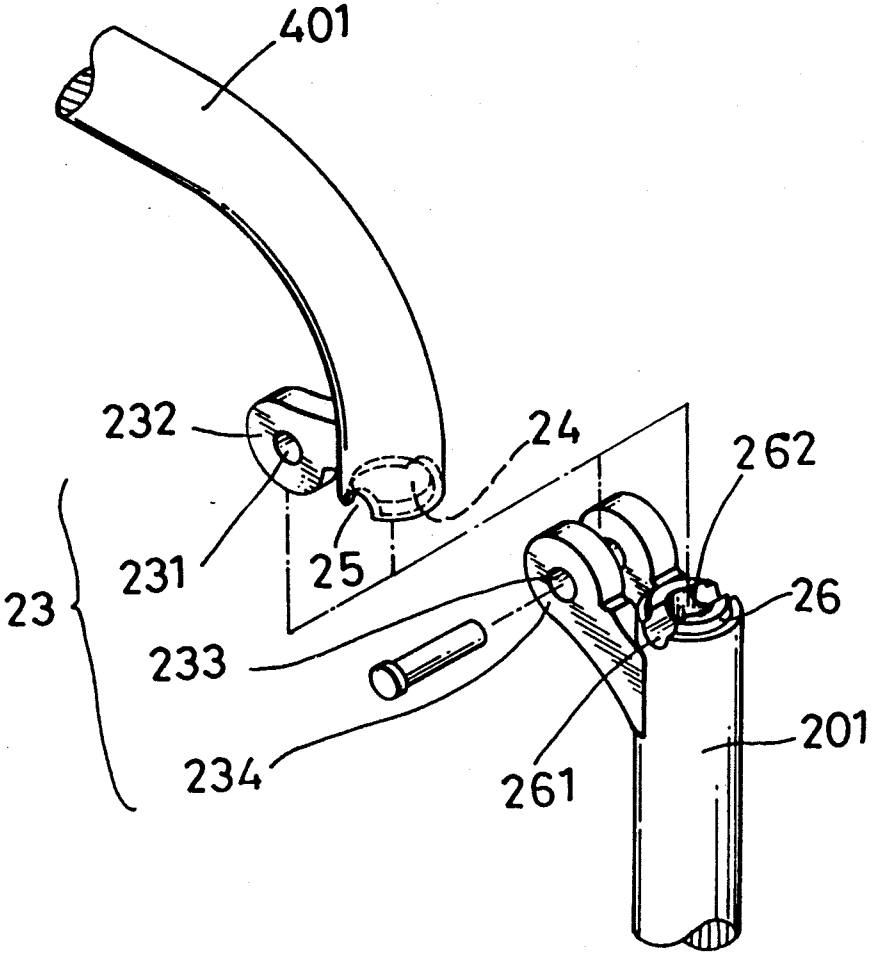
FIG. 5 is an expoded perspective view of the collapsible hinge attached on two extension poles in the collapsible tent frame in the present invention.

The collapsible hinge 23 shown in FIGS. 5 and 6 is used to connect a vertical extension pole 201 with a horizontal extension 401 in nearly a right angle so that the horizontal portion of the reverse U-shaped frame unit and two parallel vertical portion of the frame unit can be assembled together to form a complete frame unit. The collapsible hinge 22 has a round projection 232 fixed at one end of each horizontal extension pole 401, and a pin hole 231 is bored in the projection 232. The hinge 23 also has a round projection 234 formed at one end of each vertical extension pole 201, and the projection 234 has a pin hole 233 and a middle opening for the projection 232 to fit therein and then a pin is inserted through the pin holes 34 and 231 so that the hinge 23 may be movably combined together. The horizontal extension pole 401 also has a hole 24 in the end and a semi-circular notch 25 in both sides of the hole 24. The vertical extension pole 201 has a semi-circular notch 261 in both sides of its end, a projection 26 in the end surface and a semi-circular hole 262 in the projection 26 for a rope 6 to pass through to keep the frame units spaced apart in a proper distance.

Figure 4:
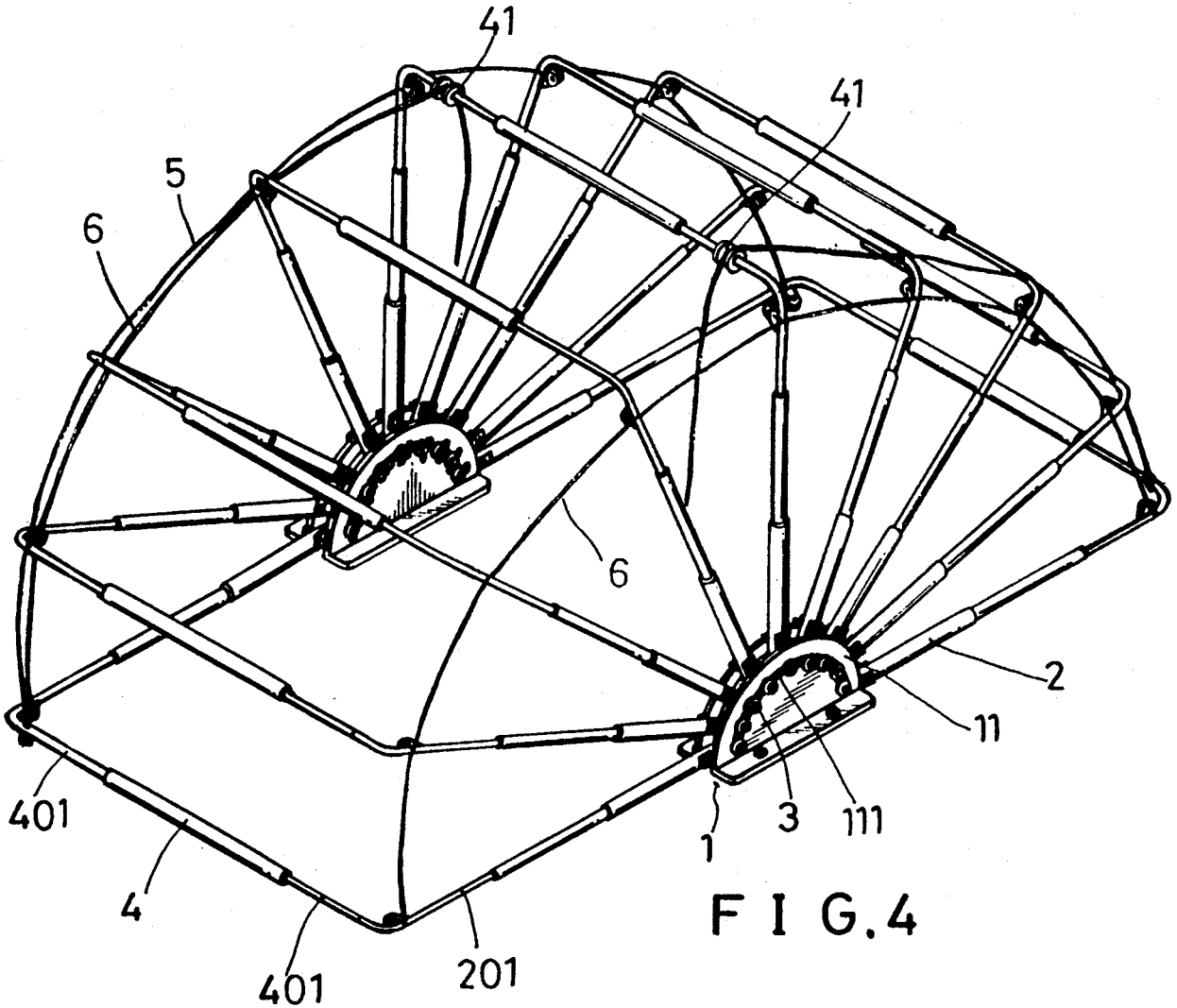
FIG. 4 is a perspective view of the collapsible tent frame completely assembled together in the present invention.

In assembling this collapsible tent frame, referring FIGS. 4 and 6, at first the main frame poles 2 are inserted in the groove 12 in the pole position base 1, the bolts and the wing nuts 33 are screwed tightly together, and then all the frame poles 2 and the extension poles 201 and 401 and the frame tubes 4 are connected together by means of the hinges 23. Next, all of the frame units are to be properly spaced apart and stabilized by means of the position members 22, and then the two position ropes 6 are to be passed through the notches 25, 261 and the holes 24 and 262 in the end of each two extension poles 201 and 401 and the rope 6 pinched between two neighboring extension poles should be properly adjusted to space the frame units apart at a proper distance. The projection 26 in the end of the vertical extension pole 201 is made to protrude in the hole 24 in the end of the extension rod 401 as shown in FIG. 6 to tightly position the two position ropes 6.

Figure 9:
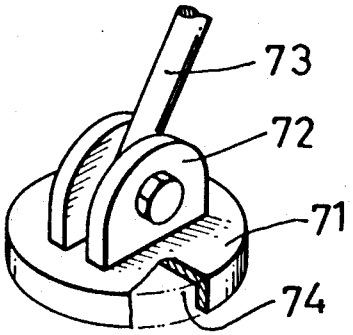
FIG. 9 is a perspectived view of the sustaining base in the collapsible tent frame in the persent invention.
Figure 8:
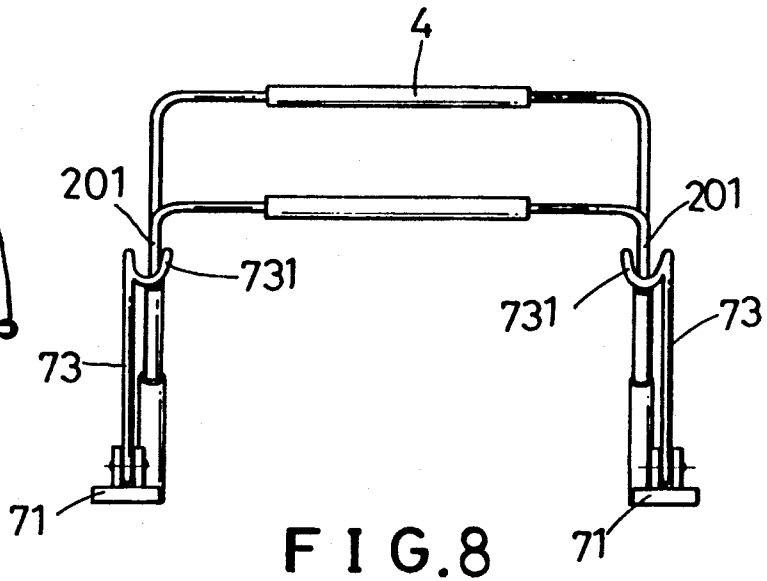
FIG. 8 is a front view of the sustaining bases sustaining the outer-most frame unit in the collapsible tent frame in the present invention.
Figure 7:
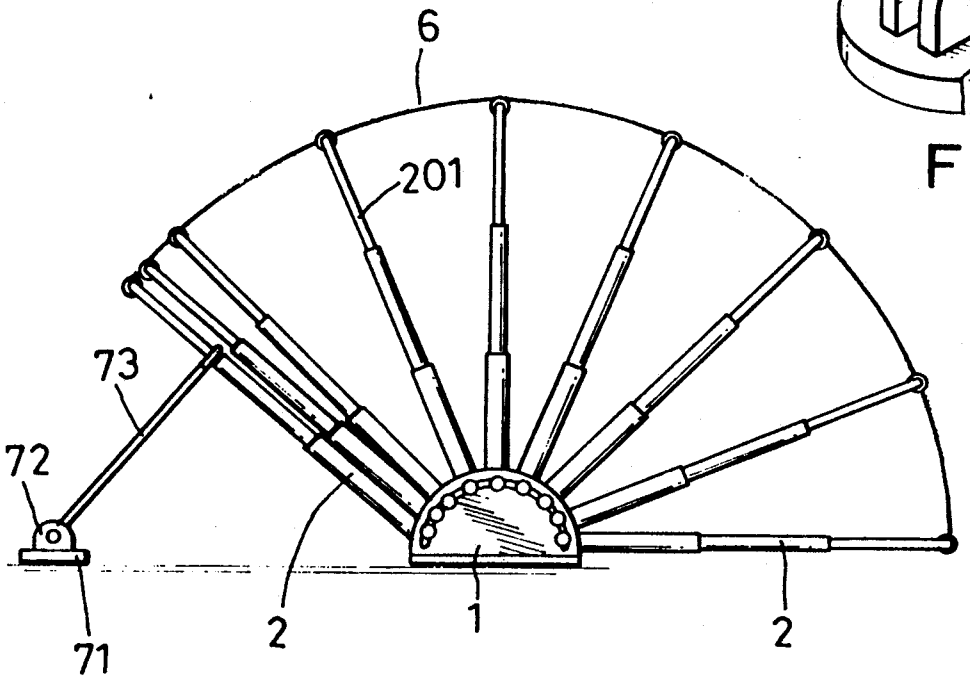
FIG. 7 is a side view of the sustaining bases sustaining the outer-most frame unit in the collapsible tent frame in the present invention.

If the tent is to be lifted to a certain height at one side to form an entrance after the tent has been guide rope 5, which has the other end bound on the assembled, a user inside the tent holds the end of the extension pole 201 of the lowest (or the outer-most) frame, and pulls the rope 5 forcing the frame tube 4 of the said frame to be pulled up, and then the next neighboring frame of the lowest one to be pulled up, and so on to form an entrance of a proper height, and then two sustaining bases 7 shown in FIGS. 7, 8 and 9 are used to sustain the two opposite frame poles 2 by means of a hook 73 at the top end of sustaining rod 73 pivotally connected between two parallel upright walls 72 on a base plate 71 of each sustaining base 7. The sustaining plate 71 has a recessed cavity 74 in the rear side to face the ground, and the recessed cavity 74 can be managed to such out the air therein to become vacuum when it is placed on the ground, and thus the sustaining base 7 can be stabilized on the ground.

What is claimed is:

1. A collapsible tent frame comprising;

two pole position bases for supporting the lower ends of two main frame poles, having respectively two semi-circular arms extending in parallel from one side to the opposite side, a semi-circular slot under each of said semi-circular arms for a bolt to pass through to screw with a wing nut, a semi-circular groove formed between two parallel walls under said semi-circular slots for the end of each main frame pole to stand therein;

a plurality of frame units to form the tent frame to support a tent cloth or canvas, shaped as reversed U, each frame unit consisting of two main frame poles, two vertical extension poles connected with said main frame poles, a horizontal frame tube, two horizontal extension poles connected with both sides of the frame tube to form the horizontal portion of each said frame unit to support the roof portion of the tent cloth, said main frame pole and the vertical extension pole forming one of the parallel portion of each said frame unit, each said vertical extension pole being connected with each horizontal extension pole by means of a collapsible hinge to enable both extensions poles connected in about a right angle, each said main frame pole having a sidewise through hole at the bottom portion for a bolt passing through said semi-circular slots in said pole position base to pass through to screw with a wing nut, and a position member extending to two opposite sides to closely contact the upper surfaces of said two parallel arms in said pole position base;

a plurality of collapsible hinges respectively having a middle annular projection and a two annular projection, said middle annular projection attached on the end of said horizontal extension pole and said two annular projection attached on the end of said vertical extention pole, both of said projections provided with a sidewise hole for a pin to pass through to combine both the projections together and thus also combine both said vertical and said horizontal extension pole together; and two position ropes for holding all the frame units properly spaced apart from one another, passing through the semi-circular notches in both the ends of each horizontal and each vertical extension pole and passing over the central projection in the end of the vertical extension pole so that the rope can be positioned firmly.

2. The collapsible tent frame as claimed in claim 1, wherein two sustaining bases are provided to sustain the two parallel portions of said frame units in case of some of said frame units are pulled to swing upward to make an entrance for the tent, and said sustaining bases respectively have a hook to support the main frame pole, a base plate having a rear cavity to face the ground, said cavity being managed to become vacuum to enable said bases to sit on the ground stabilized by sucking the air therein out after said base is placed on the ground, two parallel walls on the base plate and a sustaining rod pivotally pined between said two walls and having its top end formed as a hook.

* * * * *